US005934602A

United States Patent [19]

Jendroska et al.

[11] Patent Number: 5,934,602

[45] Date of Patent: Aug. 10, 1999

[54] DEVICE FOR WINDING WEB-SHAPED MATERIAL

[75] Inventors: Rainer Jendroska, Greven; Matthias Sieringhaus, Münster, both of Germany

[73] Assignee: Windmoeller & Hoelscher, Lengerich/Westf., Germany

[21] Appl. No.: 09/017,687

[22] Filed: Feb. 3, 1998

[30] Foreign Application Priority Data

Feb. 6, 1997 [DE] Germany ..... 197 04 555

[51] Int. Cl.[6] ..... B65H 18/04; B65H 19/22

[52] U.S. Cl. ..... 242/533.6; 242/598.1

[58] Field of Search ..... 242/533.4, 533.5, 242/533.6, 559.2, 598.1

[56] References Cited

U.S. PATENT DOCUMENTS

| | | | |
|---|---|---|---|
| 1,732,740 | 10/1929 | Cline . | |
| 2,707,596 | 5/1955 | Ehret | 242/598.1 |
| 3,266,744 | 8/1966 | Volm et al. | 242/533.6 |
| 3,383,062 | 5/1968 | Meihofer et al. | 242/533.5 |
| 3,527,425 | 9/1970 | Shumaker | 242/598.1 |
| 3,985,313 | 10/1976 | Klein et al. | 242/533.6 |
| 4,030,681 | 6/1977 | Schott | 242/533.4 |
| 5,054,707 | 10/1991 | Olson | 242/533.5 |
| 5,732,901 | 3/1998 | McNeil et al. | 242/533.4 |

FOREIGN PATENT DOCUMENTS

| | | |
|---|---|---|
| 1 265 525 | 4/1968 | Germany . |
| 72 04 496 | 7/1972 | Germany . |
| 24 37 237 | 2/1976 | Germany . |
| 28 10 809 | 9/1978 | Germany . |

*Primary Examiner*—John M. Jillions

*Attorney, Agent, or Firm*—Jacobson, Price, Holman & Stern, PLLC

[57] ABSTRACT

A device for winding web-shaped material on winding sleeves into winding rolls and for unwinding winding rolls with a beam, which floats in a frame and can be rotated around a horizontal axis and at which at least two winding shafts, which are provided with drives and can be rotated around vertical axes, are mounted so as to float. To provide simple access to the winding shafts when said winding shafts are mounted so as not to oscillate, traverses are attached to the beam, said traverses supporting bearings, which can be moved between their fixable position bearing the free ends of the winding shafts and their position releasing them.

8 Claims, 2 Drawing Sheets

DEVICE FOR WINDING WEB-SHAPED MATERIAL

FIELD OF THE INVENTION

The invention relates to a device for winding web-shaped material on winding sleeves into winding rolls and for unwinding winding rolls with a beam, which floats in a frame and can be rotated around a horizontal axis and at which at least two winding shafts (center sleeves), which are provided with drives and can be rotated around horizontal axes, are mounted so as to float.

BACKGROUND OF THE INVENTION

One special problem associated with winding and unwinding devices for winding rolls lies in the fact that the winding sleeves, forming the cores of the winding rolls, are slid on center sleeves and have to be pulled off from them, a process that is possible only if one end of the center sleeves is free and freely accessible. To guarantee this free accessibility, it is well-known that the center sleeves can be suspended from their beams so that there is free access, However, this suspension of the center sleeves can lead to trouble during the winding and unwinding procedure, if they are not adequately rigid and tend to oscillate due to their length. Such undesired oscillations must cause grave concern, especially when the center sleeves are long and serve with significant weight the purpose of winding the winding rolls, since then the heavy winding rolls, located on the center sleeves, form a spring-mass system that tends to oscillate.

SUMMARY OF THE INVENTION

Therefore, the object of the invention is to provide winding and unwinding devices of the type designated in the introductory part, where the winding rolls, located on the center sleeves, cannot oscillate or vibrate in an undesired manner.

The invention solves this problem by attaching to the beam the traverses, which support bearings, which can be moved between their fixable position, bearing the free ends of the winding shafts, and their position releasing them.

The device, according to the invention, provides bearings, which are connected rigidly to the beam, bearing the center sleeves, and which bear the free ends of the center sleeves and thus brace them, so that they cannot oscillate in an undesired manner. Owing to the bearings mobility, they can be moved easily and quickly between their position, bearing the center sleeves, and their position releasing the same, so that there is no adverse effect on the ease with which the device can be manipulated.

Expediently the beam is connected to two traverses, which run parallel to the winding shafts and at whose free ends pivotable bearing brackets, provided with the bearings, are mounted. During the winding and unwinding operation these bearing brackets can be pivoted in their position bearing the center sleeves and can be fixed in this position and can be swung down again in order to release the center sleeves.

To lock the bearing brackets in their swung down position, they are provided expediently with holding mechanisms. They can comprise customary gas pressure springs, whose cylinder or piston rods are hinged to the bearing brackets or traverses. Since the bearing brackets are swung down only when the winding device is standing still, the holding mechanisms or gas pressure springs have only to guarantee that the bearing brackets are held in their swung down position.

Another design of the invention provides that the beam is mounted by means of a hollow journal in the frame and that a hollow shaft is mounted in the journal and in said hollow shaft is mounted a shaft, whose ends, projecting beyond the beam, bear chain wheels or belt pulleys, over which the continuous chains or belts, driving the winding shafts, run. In this manner the winding shafts for winding and unwinding webs can be driven in a simple manner.

The other ends of the shafts and hollow shafts also bear expediently chain wheels or belt pulleys, over which chains or belts run for the purpose of driving said wheels or pulleys.

The shaft journal of the beam itself can bear a chain wheel to drive the same. In principle this drive is activated only for the purpose of changing the winding rolls.

A preferred embodiment provides that to lock the bearing brackets in the position, bearing the winding shaft, to a bolt, which can be slid axially on the traverse, eccentric rollers or disks are provided. The bolts can be rotated around a specific angle so that they exert the requisite pressure on the bearing brackets by means of the eccentric rollers or disks.

To rotate the bolts into their locking position and to lock said bolts in said locking position, said bolts are provided expediently with an actuating lever and can be slid axially in a bushing attached to a traverse, whereby a slide catch for fixing the bolt in the locking position is provided.

One embodiment of the invention is explained in detail with reference to the drawings in the following.

DETAILED DESCRIPTION OF THE PREFERRED EMBODIMENTS

Figure 1:
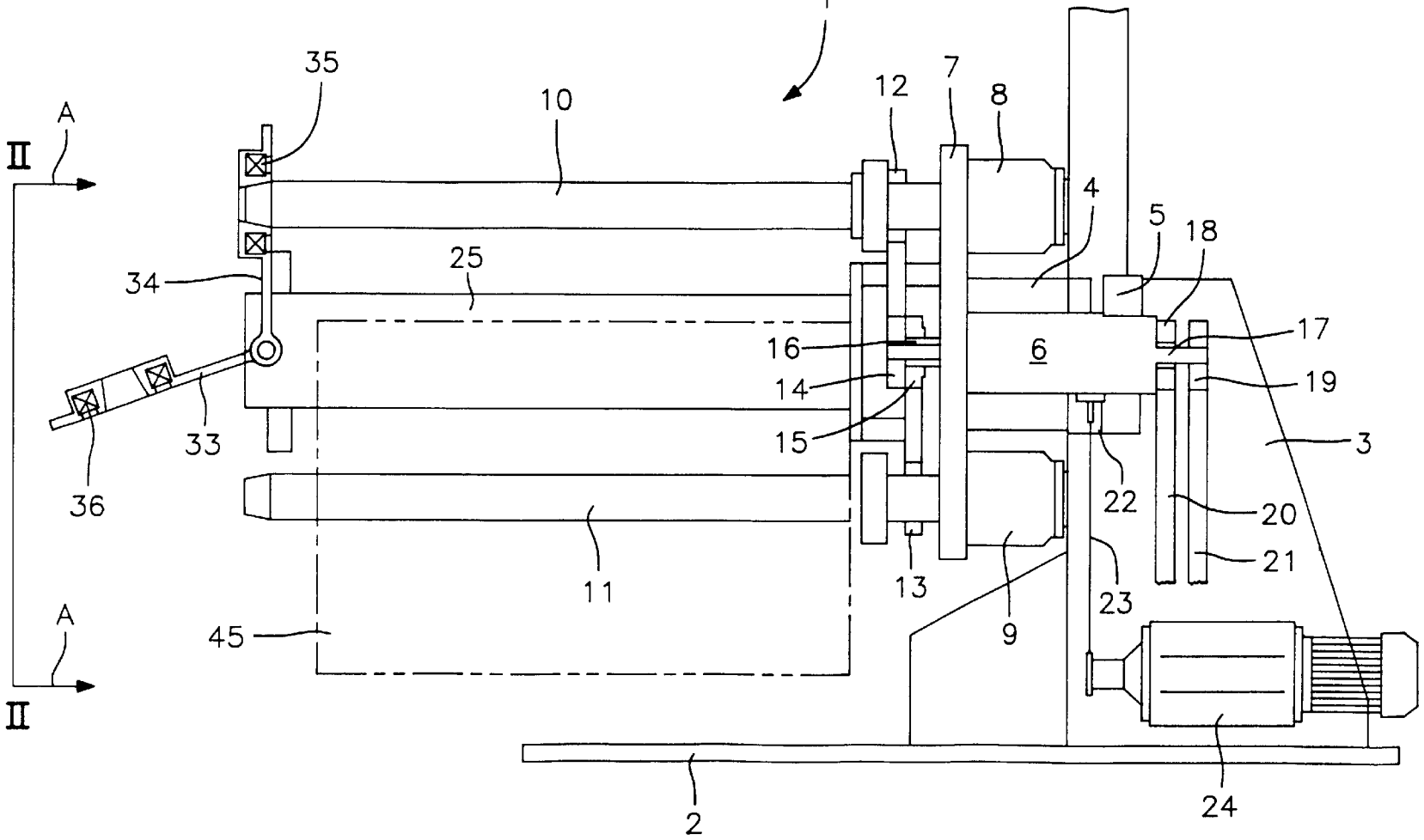
FIG. 1 is schematic drawing of a cross sectional side view of the winding and unwinding device.
Figure 3:
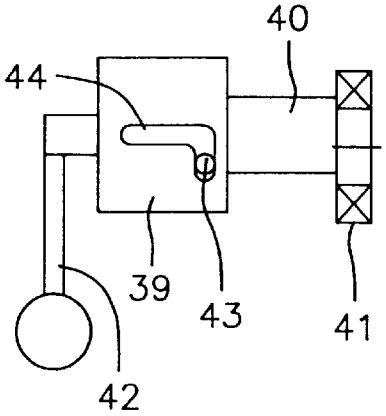
FIG. 3 is an enlarged view of the locking bolt, indicated by a dashed circle in FIG. 2.

The frame of the winding and unwinding device 1 consists of a base frame 2, which bears two parallel side members 3 for winding a winding roll 45 of material. Brackets 4, 5 are connected in the customary manner in the form of a yoke to the side members 3; a hollow pin 6 can be freely pivoted in said brackets and the left end of said hollow pin is connected to a disk-shaped beam 7. Two winding shafts (center sleeves) 10, 11 are mounted in bearings 8, 9 at the beam 7 and can be freely pivoted concentrically to the axis of the pin 6. Synchronous belt pulleys 12, 13 are keyed to the winding shafts 10, 11; said pulleys can be driven via synchronous belts by synchronous belt pulleys 14, 15, which are attached on a hollow shaft 16, which is mounted so as to rotate freely in the pin 6, and on a shaft 17, which can rotate freely in the hollow shaft 16. Synchronous belt pulleys 18, 19, over which run continuous synchronous belts 20, 21, driven by drives (not illustrated), are keyed to the opposite free ends of the hollow shaft 16 and shaft 17. Pulleys 15 and 18 are connected to shaft 16 and pulleys 14 and 19 are connected to shaft 17, whereby the winding shafts can be independently driven.

Between the brackets 4, 5 bearing the hollow pin 6, a chain wheel 22 is keyed to the pin 6; said chain wheel can be driven over a continuous chain 23 by a gear motor 24, which is mounted on a side member 3.

Parallel to the winding shafts 10, 11, freely cantilevered traverses 25, 26 are mounted on the beam 7; and in particular in such manner that their common center plane 27 intersects at right angles the center plane 28, in which the axes of the winding shafts 10, 11 lie. The traverses 25, 26 bear pins 29, 30, which are brought into alignment in the central plane 27 and on which the overlapping bearing legs 31, 32 can be pivoted from bearing brackets 33, 34. The bearing brackets 33, 34 are provided with hinged bearings 35 36, which can be put on the free ends of the winding shafts 10, 11 in the manner shown in FIG. 1 and can be swung down from the same. To hold the bearing brackets 33, 34 in their swung down positions, there are gas pressure springs 38, whose cylinders are hinged to the traverses 25, 26 and whose piston rods are hinged to the bearing brackets 33, 34.

Figure 2:
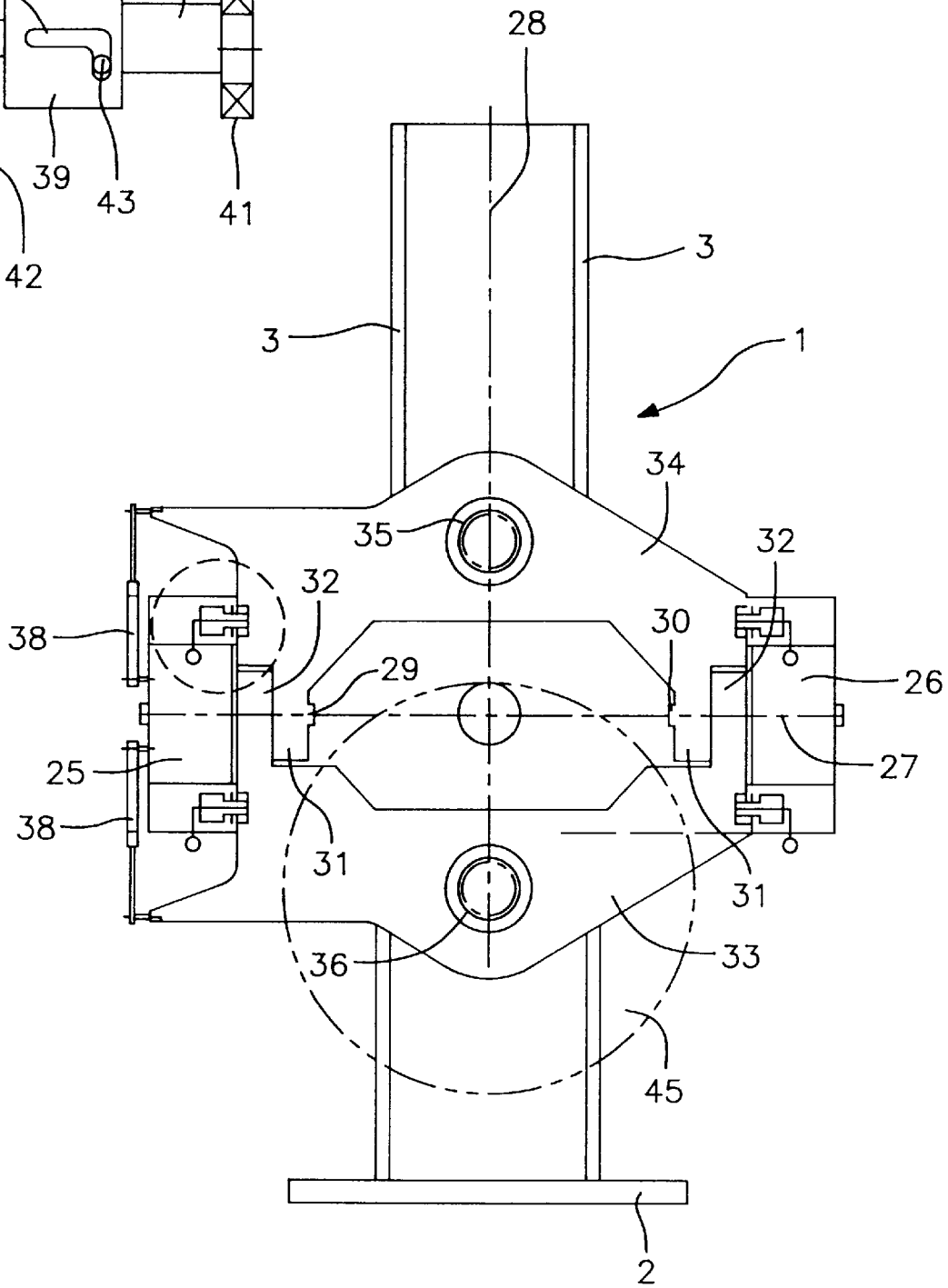
FIG. 2 is a view of the device in the direction of the arrows A in FIG. 1.

Bushings 39, in which bolts 40 can be slid axially, are mounted on the traverses 25, 26. The inner ends of the bolts bear eccentric rollers 41, which are braced against the bearing brackets 33, 34 in the locked position shown in FIG. 2 and lock said brackets in their position bearing the free ends of the winding shafts. The bolts 40 are provided with radial levers 42 and nobs for the purpose of actuating the same. Furthermore, the bolts 40 exhibit radial pins 43, which are guided in bayonet-like guide grooves 44 of the bushing 39.

We claim:

1. Device for winding web-shaped material on winding sleeve into winding rolls and for unwinding winding rolls with a beam, which is mounted in a frame and being rotatable around a horizontal axis and at which at least two winding shafts, which are provided with drives and being rotatable around horizontal axes, are mounted so as to float, and attaching to the beam traverses, which support bearings, which are movable between their fixable position, bearing the free ends of the winding shafts, and their position releasing them.

the beam being mounted by a hollow shaft journal in frame and a hollow shaft being mounted in the hollow shaft journal and in said hollow shaft is mounted a shaft, whose ends, projecting beyond the beam, bear chain wheels or belt pulleys, over which the continuous chains or belts, driving the winding shafts, run.

2. Device, as claimed in claim 1, wherein the beam is connected to the traverses, which extend parallel to the winding shafts and at whose free ends pivotable bearing brackets, provided with the bearings, are mounted.

3. Device, as claimed in claim 1, wherein to lock the traverses in a swung down position, they are provided with holding mechanisms.

4. Device, as claimed in claim 3, wherein the holding mechanisms comprise gas pressure springs, whose cylinder or piston rods are hinged to bearing brackets or the traverses.

5. Device, as claimed in claim 4, wherein to lock the baring brackets, bearing the winding shafts, eccentric rollers or disks are provided.

6. Device, as claimed in claim 5, wherein a bolt is provided with an actuating lever and is slid axially in a bushing attached to a traverse and a slide catch for fixing the bolt in its locking position is provided.

7. Device, as claimed in claim 1, wherein the other ends of the shaft and a hollow shaft also bear chain wheels, over which chains or belts run for the purpose of driving the same.

8. Device, as claimed in claim 1, therein the hollow shaft journal of the beam bears a chain wheel to drive the same.

* * * * *